United States Patent [19]

Crahay et al.

[11] Patent Number: 4,917,962

[45] Date of Patent: Apr. 17, 1990

[54] METAL PRODUCT HAVING IMPROVED LUSTER AFTER PAINTING

[75] Inventors: Jean R. Crahay, Francorchamps; Adolphe A. Bragard, Esneux, both of Belgium

[73] Assignee: Centre de Recherches Metallurgiques-Centrum VOOR Research in de Metallurgie, Brussels, Belgium

[21] Appl. No.: 77,812

[22] Filed: Jul. 27, 1987

[30] Foreign Application Priority Data

Jul. 28, 1986 [LU] Luxembourg ..... 86531

[51] Int. Cl.[4] ..... B21D 53/00

[52] U.S. Cl. ..... 428/600; 428/687

[58] Field of Search ..... 428/687, 674, 684, 600, 428/925, 601; 29/121.1, 121.8; 72/199

[56] References Cited

U.S. PATENT DOCUMENTS

| | | | |
|---|---|---|---|
| 2,991,544 | 7/1961 | Gotsch et al. | 428/687 |
| 3,619,881 | 11/1971 | Bills | 29/121 R |
| 4,071,657 | 1/1978 | Rault | 428/646 |
| 4,111,032 | 9/1978 | Rault | 72/366 |
| 4,679,288 | 7/1987 | Monfort | 29/132 |
| 4,775,599 | 10/1988 | Matsuoka | 428/925 |
| 4,783,378 | 11/1988 | Wakui et al. | 428/687 |
| 4,795,681 | 1/1989 | Furukawa et al. | 428/687 |
| 4,797,327 | 1/1989 | Honda et al. | 428/687 |
| 4,798,772 | 1/1989 | Furukawa | 428/607 |

FOREIGN PATENT DOCUMENTS

| | | | |
|---|---|---|---|
| 157754 | 10/1985 | European Pat. Off. | 428/687 |
| 264430 | 8/1968 | Fed. Rep. of Germany | 428/687 |
| 2549249 | 8/1976 | Fed. Rep. of Germany | 428/687 |
| 8330 | 4/1979 | Japan | 428/687 |
| 97527 | 8/1979 | Japan | 428/687 |
| 34441 | 8/1984 | Japan | 428/687 |
| 168602 | 7/1987 | Japan | 428/687 |
| 230402 | 10/1987 | Japan | 428/687 |
| 1045641 | 10/1966 | United Kingdom | 428/687 |
| 2040824A | 9/1980 | United Kingdom | 428/687 |
| 2069906A | 9/1981 | United Kingdom | 428/687 |

OTHER PUBLICATIONS

J. Crahay et al., "Gravure de la Rugosité des Cylindres de Laminoir par Impulsions Laser", Revue de Metallurgie-CIT, May 1983, pp. 393-401.

H. Ketcham, "Designing with Textured Metals", Product Engineering, Mar. 1949, pp. 102-103.

A. Allen, "Texturized Metals", Steel, May 24, 1948, pp. 94-97, 119-120.

"Texturing ups Strength to Lower Metal Weight", Iron Age, Aug. 23, 1976, pp 30-32.

*Primary Examiner*—John J. Zimmerman

*Attorney, Agent, or Firm*—Fleit, Jacobson, Cohn, Price, Holman & Stern

[57] ABSTRACT

A metal product, such as cold rolled steel sheet, has a surface comprising a plurality of flat, smooth facets which are preferably 50 to 100 μm across and which make up at least 30% of the area of the surface. The facets may be formed either by pressing a network of valleys in a flat, smooth surface or by flattening the peaks of a rough surface.

20 Claims, 1 Drawing Sheet

METAL PRODUCT HAVING IMPROVED LUSTER AFTER PAINTING

BACKGROUND OF THE INVENTION

1. Field of Invention

The present invention relates to a metal product having improved lustre after painting, and to methods for its production. It is particularly concerned with cold rolled sheet metal, to which special reference will be made in the following description, but it can equally be applied to other types of metal products to be painted.

2. Description of Prior Art

It is known that in order to achieve optimum lustre after painting, sheet metal of this type should ideally have a perfectly smooth and flat surface similar to the surface of a mirror. It also known that other operations, for example shaping by deep drawing, require the sheet metal to have a certain roughness, to provide inter alia adequate lubrication in order to avoid seizing.

At present, these sheet metals have a roughness made up of alternating peaks and valleys, imparted to them by the rolls in the final cold rolling stand. This relatively uniform roughness generally leads to adequate behaviour of the sheet metal during shaping operations. However, it does not allow one to achieve increased lustre of the sheet metal after painting.

SUMMARY OF THE INVENTION

An object of the present invention is to provide a surface morphology of a metal product which gives it optimum lustre after painting whilst being compatible with the demands of the other manufacturing operations, particularly shaping.

The invention provides a metal product exhibiting improved lustre after painting, having a surface comprising a plurality of smooth and flat facets, preferably situated in the same plane, and these facets make up at least 30%, preferably 50%, of the total surface.

According to one particular aspect of the invention the facets are separated by valleys providing the surface roughness of the metal product. Advantageously these valleys form a network producing a uniform pattern, possibly repetitive, in the surface of the product.

Further, the dimension of each of these facets, in whichever direction in its plane, is advantageously 50 to 200 μm.

Below 50 μm, the facets are about the same size as the valleys which separate them; they may therefore only make up an inadequate portion of the surface and may not provide the required lustre. At the other end of the scale, a dimension greater than 200 μm is not desirable, so as to avoid the appearance of damaging dispersed imperfections, such as micro-seizure during shaping operations.

This characteristic can be expressed in another way by saying that the pitch of the network is advantageously 50 to 200 μm.

The present invention also relates to processes which enable the surface morphology of a metal product which has just been described to be obtained.

In a first embodiment, the metal product is given a surface which is as flat and smooth as possible in the first stages of its production and the above-mentioned network is formed in this surface during the final stage of production.

In another important embodiment, the surface of the product can be given, before the final stage of production, a very fine roughness which is very close to the ideal plane and in any case less than the final roughness corresponding to the above-mentioned network, if this is necessary in order to facilitate the first stages of production.

During the final stage of production of the product, the final roughness is imparted by a tool having a surface which is itself provided with a network of crests for pressing the network of valleys into the product surface.

As a rule, the substantially flat portions of the tool surface between the crests do not come into contact with smooth and flat surface of the product. Nevertheless, even if such contact took place, the flat portions of the tool surface would not destroy the flatness of the facets of the product disposed between the valleys of the network so pressed.

In a second embodiment, the surface is provided with a substantially uniform roughness before the final stage in its production; then, at a later stage which may be the final one, the peaks are crushed, i.e. the peaks or crests of this roughness. by means of a smooth tool so as to form the smooth and flat facets separated by the valleys of the roughness.

BRIEF DESCRIPTION OF THE DRAWINGS

The invention will now be described in detail with reference to the accompanying drawings which show the use of the present invention in the case of cold rolled sheet steel wherein.

DETAILED DESCRIPTION OF PREFERRED EMBODIMENTS

Figure 1:
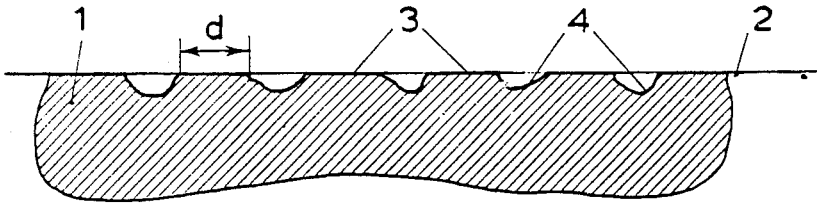
FIG. 1 shows, in cross section, greatly enlarged, the morphology of the surface according to the invention.

With reference to FIG. 1, steel sheet 1 which is to be painted is shown in section and by way of example. It may be, more particularly, sheet for a car body.

To achieve optimum lustre, the sheet metal surface should be completely flat and smooth as represented by the ideal plane 2. However, the actual surface comprises, according to the invention, smooth and flat facets 3 forming part of the ideal plane 2, separated by valleys 4 which ensure that the sheet metal is lubricated during the shaping operations.

In the plane 2, the dimension d of the facets is between 50 μm and 200 μm.

Figure 2:
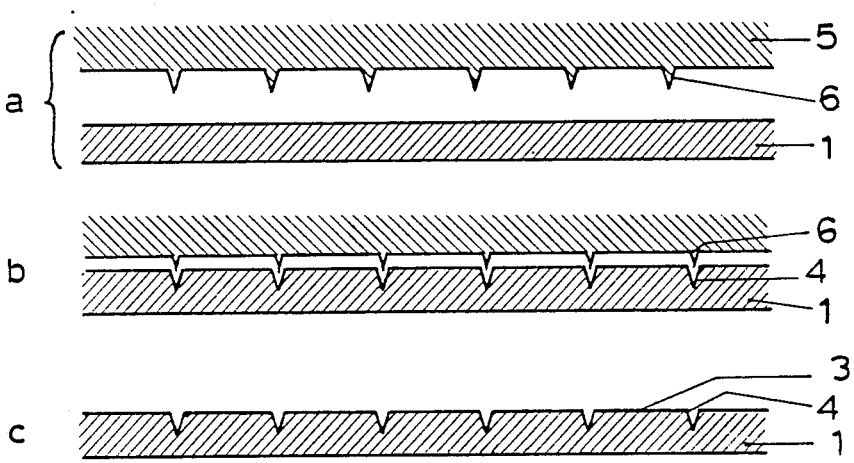
FIG. 2 shows the different stages of production leading to a morphology of this type, according to the above-mentioned first embodiment.

FIG. 2 shows, in three stages a, b, c, the production of a cold rolled metal sheet according to the invention by the first embodiment described above.

In stage a, a metal sheet 1 is shown which is flat and smooth, obtained by the previous appropriate operations, and which is to receive its final morphology. A finishing roll 5, for example a temper roll, is provided with crests 6 forming a network on its surface. In stage b, the roll 5 is pressed on to the sheet 1 and presses a network of valleys 4, the portions of the flat surface of the sheet between the valleys being able or unable to meet the portions of the surface of the roll between the crests 6. Lastly, stage c shows the resulting sheet 1, which is provided, on one face in the present example, with flat and smooth facets 3 separated by a network of valleys 4.

Figure 3:
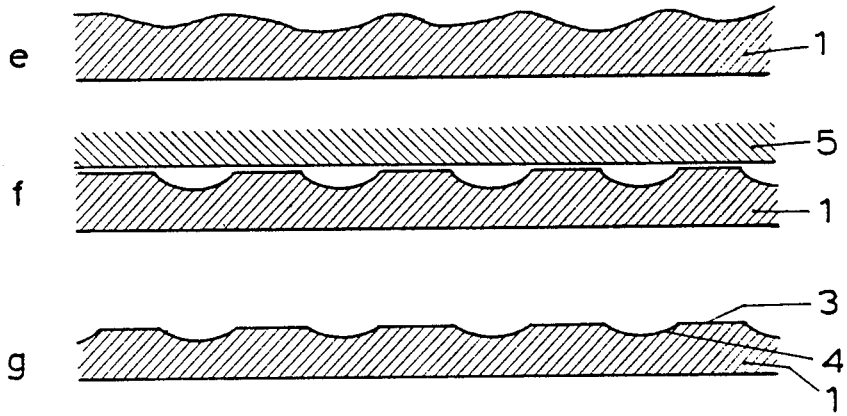
FIG. 3 shows the successive operations comprising a second embodiment having a surface morphology according to the invention.

Similarly, FIG. 3 shows in three stages e, f, g, the production of sheet metal in accordance with the aforesaid second embodiment. Stage e shows in section a sheet 1 provided with uniform roughness, for example in a tandem mill. The sheet 1 in stage f is crushed by the skin-pass method by a roll 5 whose smooth surface flattens out the peaks of the initial roughness.

The end result, i.e. a metal sheet 1 having a surface comprised of smooth and flat facets 3 separated by a network of valleys 4, is shown in stage g.

In the above examples, the metal sheet 1 has been shown each time with one face treated in accordance with the invention. It is self-evident that this invention also applies to cases where both or all faces of the product have, at least on one part of their expanse, the particular morphology proposed here.

In the framework of the present invention, it has proved to be advantageous to form the particular morphology of the surface of metal products by means of tools treated using a laser beam.

More particularly, treatment of the surface of rolling mill rolls using an intermittent laser beam allows the creation in this surface of micro-craters and crests which serve to press in the surface of the sheet metal the network of valleys leading to the required surface morphology.

We claim:

1. In a metal product exhibiting improved luster after painting including a metal member having a surface to be painted, said surface having a roughness formed by a plurality of flat and smooth facets separated by valleys, the improvement wherein:

said flat and smooth facets on said surface constitute at least 30% of the area of said surface;

said surface lies in a common plane; and all of said flat and smooth facets lie in said common plane.

2. A metal product as claimed in claim 1 wherein:

said plurality of flat and smooth facets comprise at least 50% of the area of said surface.

3. A metal product as claimed in claim 2 wherein:

each facet has a dimension in any direction in said plane in the range of 50 μm to 200 μm.

4. A metal product as claimed in claim 2 wherein:

said valleys form a network.

5. A metal product as claimed in claim 4 wherein:

each facet has a dimension in any direction in said plane in the range of 50 μm to 200 82 m.

6. A metal product as claimed in claim 5 wherein:

said surface of said metal member has a substantially uniform roughness comprising peaks and valleys; and said facets are formed by rolling said surface by a rolling tool having a smooth surface to flatten said peaks.

7. A metal product as claimed in claim 4 wherein: said network forms a uniform pattern.

8. A metal product as claimed in claim 7 wherein: said uniform pattern is regularly repeated.

9. A metal product as claimed in claim 8 wherein:

each facet has a dimension in any direction in said plane in the range of 50 μm to 200 μm.

10. A metal product as claimed in claim 7 wherein:

each facet has a dimension in any direction in said plane in the range of 50 μm to 200 μm.

11. A metal product as claimed in claim 1 wherein:

said valleys form a network.

12. A metal product as claimed in claim 11 wherein:

said network forms a uniform pattern.

13. A metal product as claimed in claim 12 wherein:

said uniform pattern is regularly repeated.

14. A metal product as claimed in claim 12 and further comprising:

each facet has a dimension in any direction in said plane in the range of 50 μm to 200 μm.

15. A metal product as claimed in claim 11 wherein:

each facet has a dimension in any direction in said plane in the range of 50 μm to 200 μm.

16. A metal product as claimed in claim 1 wherein:

each facet has a dimension in any direction in said plane in the range of 50 μm to 200 μm.

17. A metal product as claimed in claim 1 wherein:

said surface of said metal member has a substantially uniform roughness comprising peaks and valleys; and said facets are formed by rolling said surface by a rolling tool having a smooth surface to flatten said peaks.

18. A metal product exhibiting improved luster after painting comprising:

a metal member having a surface to be painted and a plurality of flat facets on said surface located in substantially the same plane and separated by valleys, the total area of said facets constituting at least 30% of the total area of said surface, made by the process comprising;

providing said surface on said metal member with a uniform roughness comprising peaks and valleys, providing a rolling tool having a substantially smooth rolling surface, rolling said surface on said metal member with said rolling tool to flatten said peaks and form said facets separated by said valleys.

19. A metal product exhibiting improved luster after painting comprising:

a metal member having a surface to be painted, and a plurality of flat facets on said surface located in substantially the same plane, and valleys between said facets, said facets constituting at least 30% of the total area of said surface, made by the process comprising;

producing a smooth surface on said metal member, providing a rolling tool having a network of raised crests on the rolling surface thereof, rolling said rolling tool on said smooth surface of said metal member to press a network of valleys thereon formed by said crests and produce said flat facets lying substantially in the same plane.

20. A metal product made by the process as claimed in claim 19 and further comprising:

treating said rolling surface on said rolling tool with a laser beam to form said network of crests before applying said rolling tool on said metal member.

* * * * *